US006609598B2

(12) United States Patent
Hsu

(10) Patent No.: US 6,609,598 B2
(45) Date of Patent: Aug. 26, 2003

(54) LUGGAGE PIECE HAVING SECTOR-LIKE EXPANDABLE SECTION

(75) Inventor: Ching Shih Hsu, Taipei (TW)

(73) Assignee: Universal World-Wide Business Inc., Taipei (TW)

( * ) Notice: Subject to any disclaimer, the term of this patent is extended or adjusted under 35 U.S.C. 154(b) by 0 days.

(21) Appl. No.: 09/981,568

(22) Filed: Oct. 17, 2001

(65) Prior Publication Data

US 2003/0000784 A1 Jan. 2, 2003

(30) Foreign Application Priority Data

Jul. 2, 2001 (TW) ..... 90211062 U

(51) Int. Cl.[7] ..... A45C 7/00
(52) U.S. Cl. ..... 190/103; 190/903
(58) Field of Search ..... D3/279, 276, 289; 190/103, 105, 18 A, 903, 108

(56) References Cited

U.S. PATENT DOCUMENTS 1,705,149 A * 3/1929 Brady ..... 190/903 X
3,443,671 A * 5/1969 Dyke ..... 190/903 X
5,671,831 A * 9/1997 Chiu ..... 190/103
5,743,447 A * 4/1998 McDermott ..... 224/153
5,875,876 A * 3/1999 Wang ..... 190/18 A
6,053,382 A * 4/2000 Wyant ..... 224/153
6,318,552 B1 * 11/2001 Godshaw ..... 190/127 X
6,357,567 B1 * 3/2002 Tsai ..... 190/18 A
6,390,259 B1 * 5/2002 Lu ..... 190/103

* cited by examiner

*Primary Examiner*—Tri M. Mai
(74) *Attorney, Agent, or Firm*—Ware, Fressola, Van Der Sluys & Adolphson LLP

(57) ABSTRACT

A luggage piece having a sector-like expandable section is disclosed. The expandable section is seamed between a body and a cover for adjusting the receiving space of a trunk. Furthermore, the body has a bottom and a top, and a longitudinal depth of a bottom is large than that of the top. By a first zipper, the cover can be opened or closed. By the action of the second zipper, the expandable section is expanded outwards and closed inwards like a sector so as to increase the receiving volume for the truck. As the legs of the luggage piece are moved outwards as much as possible so as to have a large distance with the corner wheels, thereby, a preferred stability being acquired.

2 Claims, 8 Drawing Sheets

LUGGAGE PIECE HAVING SECTOR-LIKE EXPANDABLE SECTION

BACKGROUND OF THE INVENTION

1. Field of the Invention

The present invention relates to a luggage piece having a sector-like expandable section comprising a body, a cover, a first zipper, an expandable section, and a second zipper. The body has a bottom and a top, wherein a longitudinal depth of the bottom is larger than that of the top. The cover has a fiber cloth frame and a cover having the first zipper. The expandable section is seamed between the body and cover. The second zipper is installed between the body and the cover. By the action of the second zipper, the expandable section is expanded outwards and closed inwards like a sector so as to increase the receiving volume of an object. Thereby, a larger distance is formed by the corner wheel and the leg at the bottom of the luggage piece so as to achieve preferred stability. Thus, the weight of an object is supported by the bottom without any further supporting structure. Moreover, the legs of the luggage piece are moved outwards as much as possible so as to have a large distance between the corner wheels, thereby, achieving greater stability.

2. Description of Related Art

Referring to FIG. 9, a prior art luggage piece is illustrated. The expandable section 2 of a prior art luggage piece 1 is formed by a fiber cloth frame having an equal width along the length of the frame. The zipper 3 of the expandable section 2 winds around the whole outer frame 4 of the luggage piece 1. When the expandable section 2 is used, the expandable section 2 is expanded outwards so as to increase the receiving space of the expandable section 2. However, in this prior art design, the longitudinal depth of the luggage piece is shallow. The distance between the legs 5 and the corner wheels 6 is smaller. Therefore, the luggage piece 1 is not stable when used.

Moreover, when the expandable section is not used, the line of the gravitational center of the luggage piece 1 is approximately located in the center position of the legs 5 and the corner wheels 6. However, once the luggage piece 1 expands outwards, the increased weight moves the line of the gravitational center of the luggage piece 1 to a place near the legs 5 so that the stability of the object is very poor. Thus, only a small force will induce the luggage piece to fall down. Moreover, in general, the expandable section 2 has no strong support. A further supporter 7 must be installed at a bottom of the luggage piece in order to support the weight of an object in the expandable section. Otherwise, an object placed in the expandable section may be destroyed.

Furthermore, since the zipper 3 winds around the outer frame 4 of the luggage piece, the zipper 3 must be opened around the whole outer frame of the luggage piece 1, if the expandable section 2 is to be used. The expandable section 3 can then expand outwards. Therefore, a rotation of the luggage piece of approximately 360 degrees is necessary, which is inconvenient. If the user desires to close the expandable section, it is possible that the zipper is released so that the user must take some time to search for the puller of the zipper, which is also inconvenient.

SUMMARY OF THE INVENTION

Accordingly, the primary object of the present invention is to provide a luggage piece having a sector-like expandable section, wherein a expandable section is seamed between a body and a cover for adjusting the receiving space of a luggage piece. Furthermore, the body has a bottom and a top, and a longitudinal depth of the bottom is larger than that of the top. Moreover, the legs of the luggage piece are moved outwards as much as possible so as to have a large distance between the corner wheels, thereby, achieving greater stability.

Another object of the present invention is to provide a luggage piece having a sector-like expandable section, wherein the weight of an object is supported by the bottom without further supporting structure, the structure being very simple and steady. By the action of the second zipper, the expandable section is expanded outwards and closed inwards like a sector so as to increase the receiving volume of an object.

A further object of the present invention is to provide a luggage piece having a sector-like expandable section, wherein when the expandable section 40 expands outwards so as to increase the receiving volume of an object, the line of the gravitational center of the luggage piece passing through the center of the corner wheels 15 and legs 16, so as not to reduce the stability of the luggage piece, further reducing the possibility that the luggage piece may fall down.

A still further object of the present invention is to provide a luggage piece having a sector-like expandable section, wherein the second zipper is installed between the body and the cover with a configuration like an inverse U shape instead of winding around the whole luggage piece, thereby making it easier to operate.

A still further object of the present invention is to provide a luggage piece having a sector-like expandable section, wherein a central position of the second zipper is installed with a stopper. As the second zipper is closed, the puller of zipper is exactly positioned on the center of the top of the luggage piece.

To achieve the previous objects, the present invention provides a luggage piece comprising:

- a body 10 having a bottom side 13 and a top side 14 as defined when the luggage piece is placed in a substantially upright position, wherein the bottom side 13 has a bottom depth $D_B$ and the top side as a top depth $D_T$ smaller than the bottom depth;
- a front portion 66 and an opposing rear portion 68 defining a luggage volume;
- a pair of front supports 16 disposed on the bottom side near the front portion;
- a pair of rear supports 15 disposed on the bottom side near the rear portion and separated from the front supports 16 by a base depth $D_W$, wherein the base depth is approximately equal to the bottom depth for providing stability to the luggage piece in the upright position;
- a cover 20 disposed on the front portion; and
- an expandable section 40 disposed on the front portion between the cover and the body, wherein the expandable section can be expanded outward from the front portion so as to increase the luggage volume by changing the top depth while keeping the bottom depth substantially unchanged.

According to the present invention, the luggage piece further comprising a handle 17 disposed on the rear portion, wherein the rear supports 15 are wheels for allowing a user to move the luggage piece while pulling the luggage piece by the handle 17.

According to the present invention, the expandable section 40, which is seamed with the body 10 near the front portion 66, is an extended part of the body 10.

According to the present invention, a zipper 50 is provided between the cover 20 and the body 10 near the front portion 66 and the zipper 50 can be closed to conceal the expandable section 40 or opened to allow the expandable section 40 to expand outward.

According to the present invention, a zipper 30 is provided between the cover 20 and the body 10 near the front portion 66 and the zipper 30 can be closed to close the cover 20 on the body 10 and the zipper 30 can be opened to open the cover 20 from the body 10.

According to the present invention, the cover 20 comprises one or more storage compartments or bags 23.

The various objects and advantages of the present invention will be more readily understood from the following detailed description when read in conjunction with FIGS. 1 through 9.

DETAILED DESCRIPTION OF THE PREFERRED EMBODIMENTS

Figure 1:
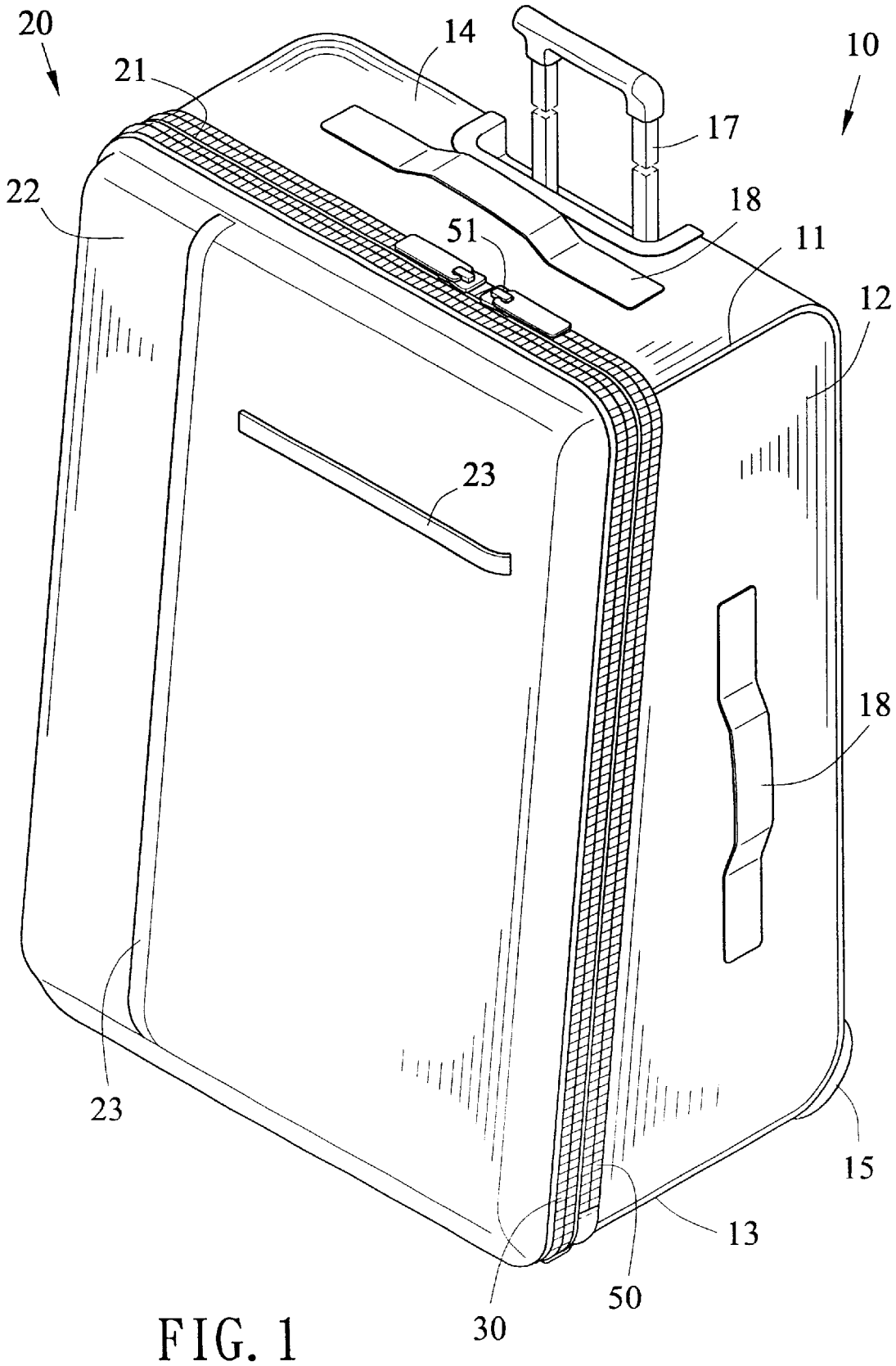
FIG. 1 is a schematic perspective view of a preferred embodiment of the present invention.
Figure 2:
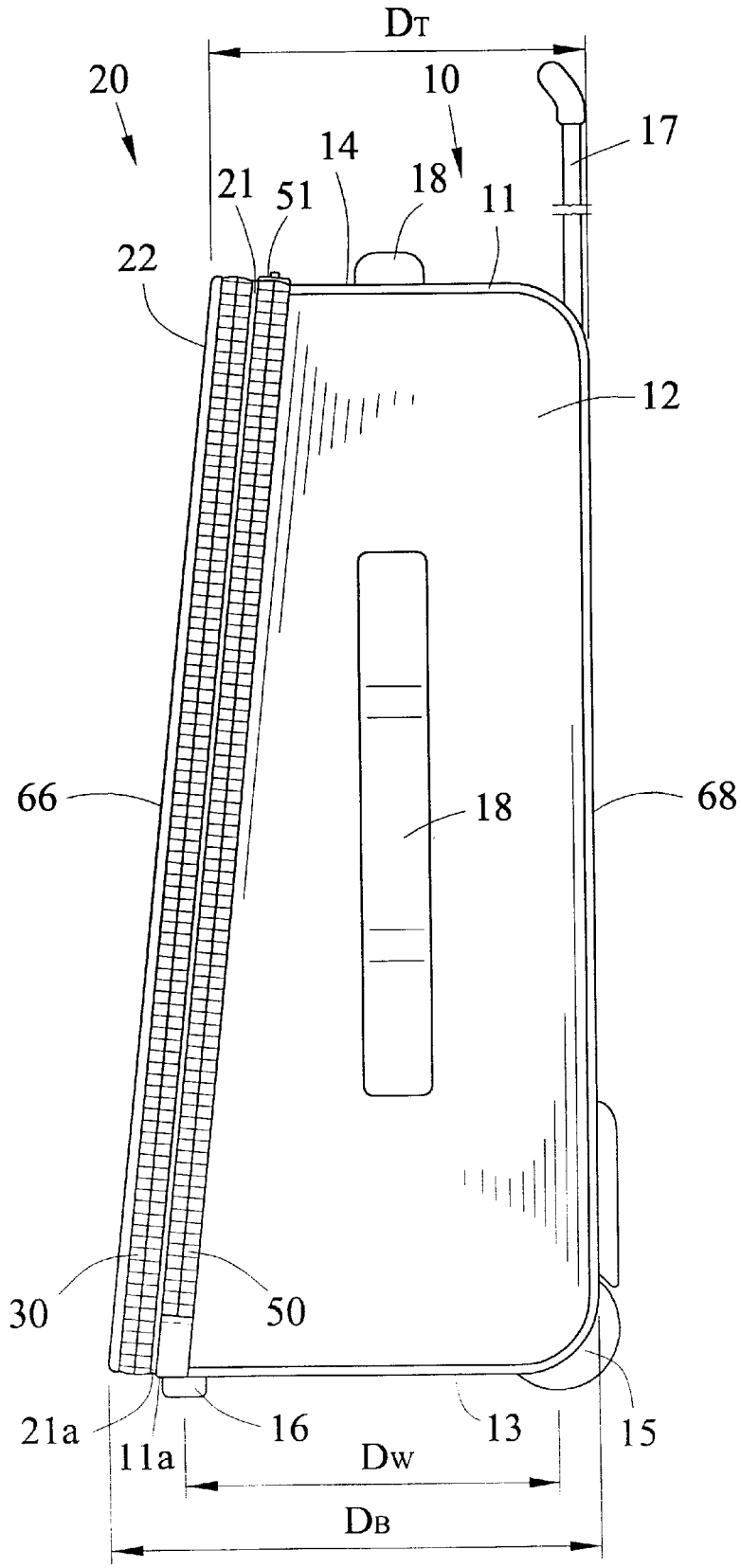
FIG. 2 is a right side view of the preferred embodiment of the present invention.

Referring to FIGS. 1 to 5 in the first preferred embodiment, the present invention includes a body 10, a cover 20, a first zipper 30, an expandable section 40 and a second zipper 50.

The body 10 is formed by a fiber cloth frame 11 and a framework 12. The longitudinal depth $D_B$ of the bottom 13 is larger than the depth $D_T$ of the top 14. The bottom 13 is installed with a pair of corner wheels 15 and a pair of legs 16. The wheels 15 and the legs 16 are separated by a distance $D_W$. Furthermore, a pull handle 17, a carrying handle 18 and an edge cloth auxiliary leg 19 (see FIG. 5), etc. can be installed.

The cover 20 is formed by a fiber cloth frame 21 and a cover 22. The lower cloth edge 21*a* of the fiber cloth frame 21 is seamed with the lower cloth edge 11*a* of the fiber cloth frame 11. The cloth edge 21*b* of the fiber cloth frame 21 is seamed to the cloth edge 22*b* of the cover 22. A first zipper 30 is formed between the fiber cloth frame 21 and the cover 22.

The length of the first zipper 30 may cover three edges of the fiber cloth frame 21 and the cover 22 for opening and closing the cover 22.

The expandable section 40 is a fiber cloth frame having a non-uniform width. Two lateral seaming edges are fixed to the fiber cloth frame 11 and the fiber cloth frame 21 for being connected to the body 10 and the cover 20.

Figure 3:
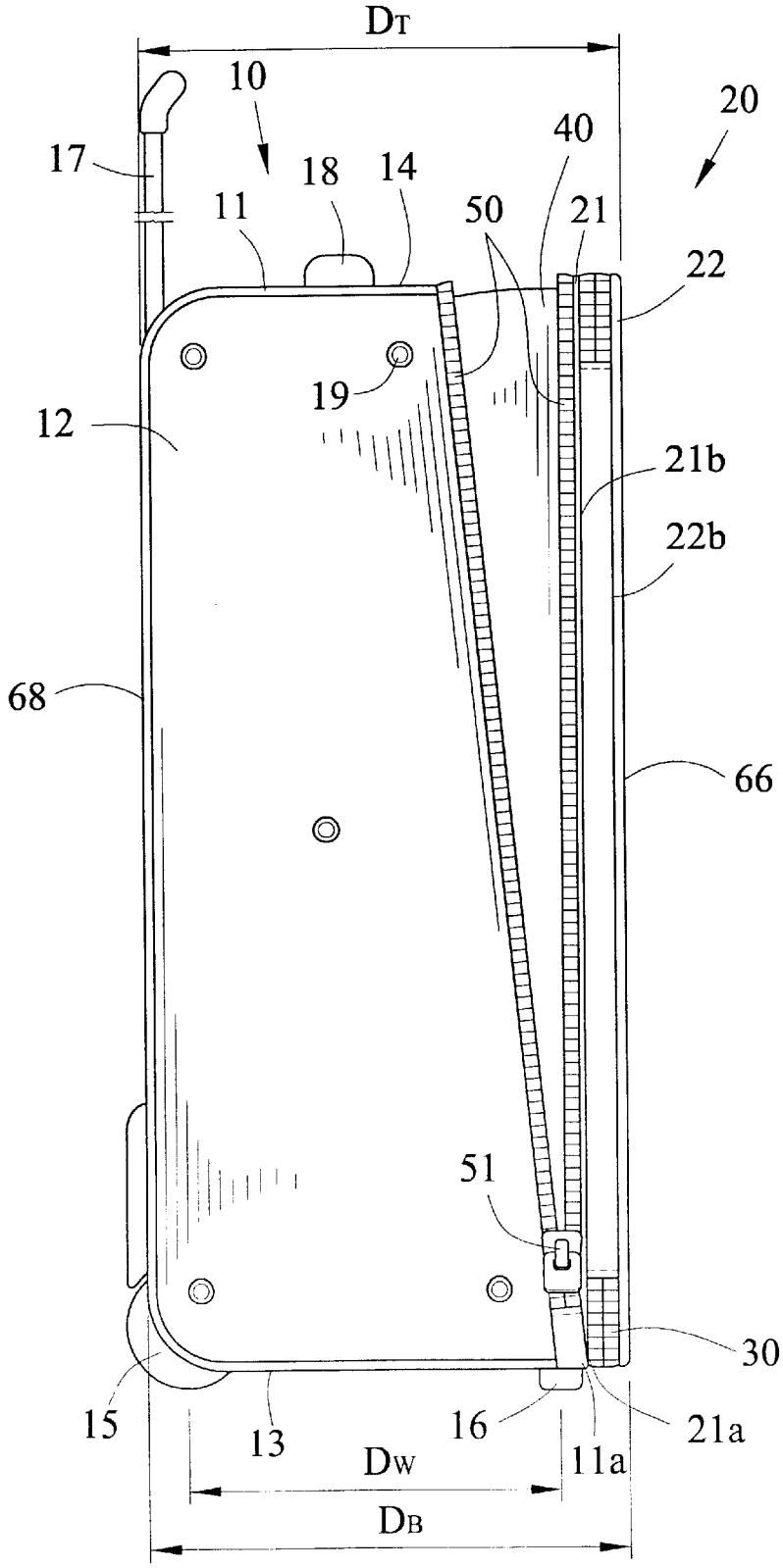
FIG. 3 is a left side view of the present invention showing that the expandable section of the present invention is expanded.

The second zipper 50 is installed between the body 10 and the cover 20 with a configuration like an inverse U shape. The length of the second zipper 50 may cover the three lateral edges of the body 10 and the cover 20 so that the body 10 and the cover 20 can be received tightly. The expandable section 40 is thus hidden. When the second zipper 50 is opened, the expandable section 40 is expanded in a sector-like way so as to adjust the receiving space of the luggage piece, as shown in FIG. 3.

Thereby, the large distance $D_W$ is formed by the corner wheel 15 and the leg 16 for preferred stability. The weight of an object can be supported by the bottom 13 without further supporting structure. Even when the expandable section 40 is expanded outwards so as to increase the receiving volume of an object, the expanded depth $D_T$ of the top 14 is substantially equal to the depth $D_B$ of the bottom 13. The line of the gravitational center of the luggage piece still passes through the center of the corner wheels 15 and legs 16 so as not to reduce the stability of the luggage piece. Furthermore, the possibility that the luggage piece can fall down is greatly reduced.

Figure 4:
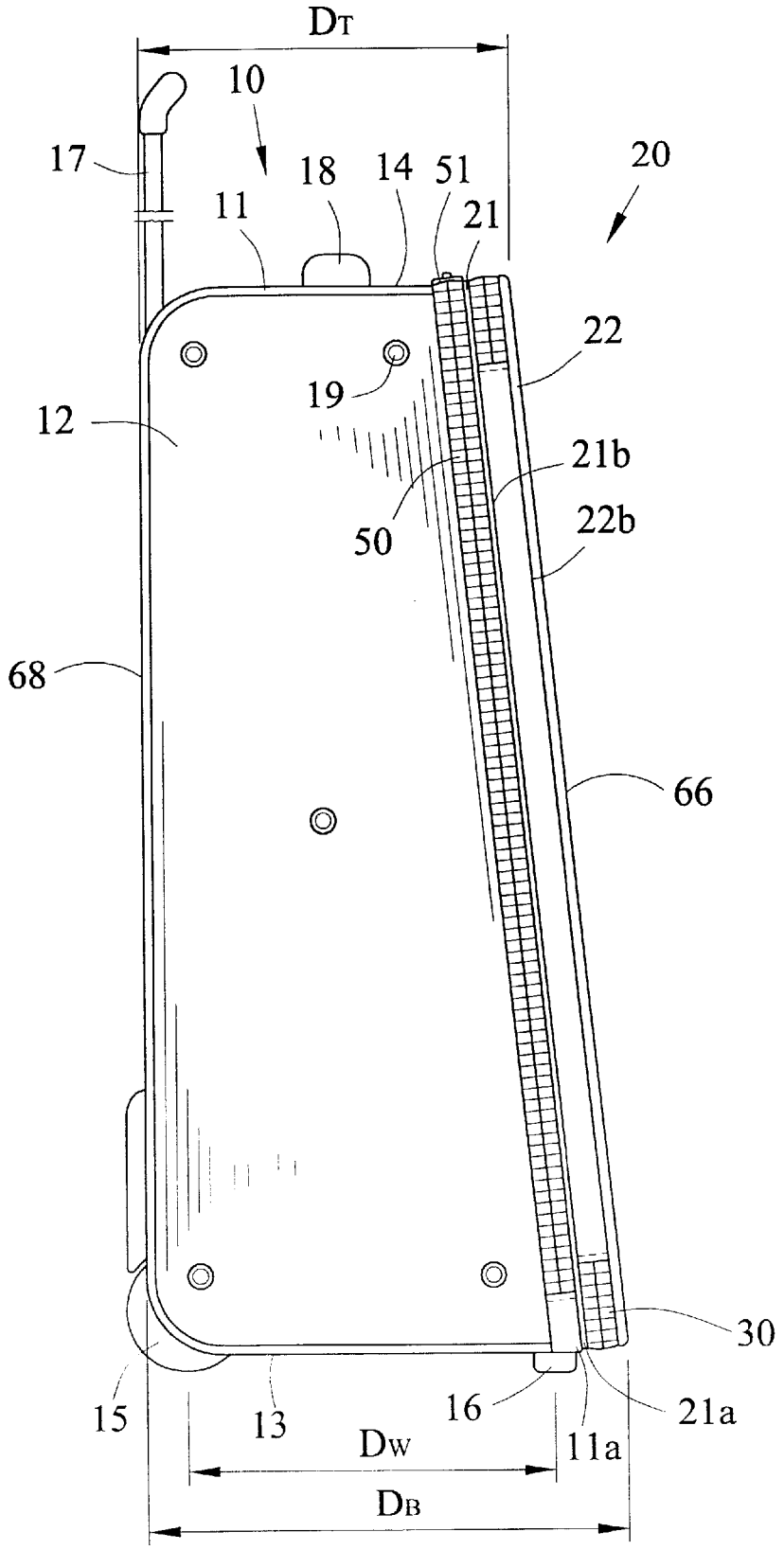
FIG. 4 is a left side view of the present invention showing that the expandable section of the present invention is closed.

Referring to FIG. 4, when the second zipper 50 is closed, the body 10 and the cover 20 may be received tightly to hide within the expandable section 40. Since the second zipper 50 is not wholly wound around an outer frame of the luggage piece, the operation is easy. Furthermore, the luggage piece has a cross section like a trapezoidal shape, thereby being more stable.

Figure 5:
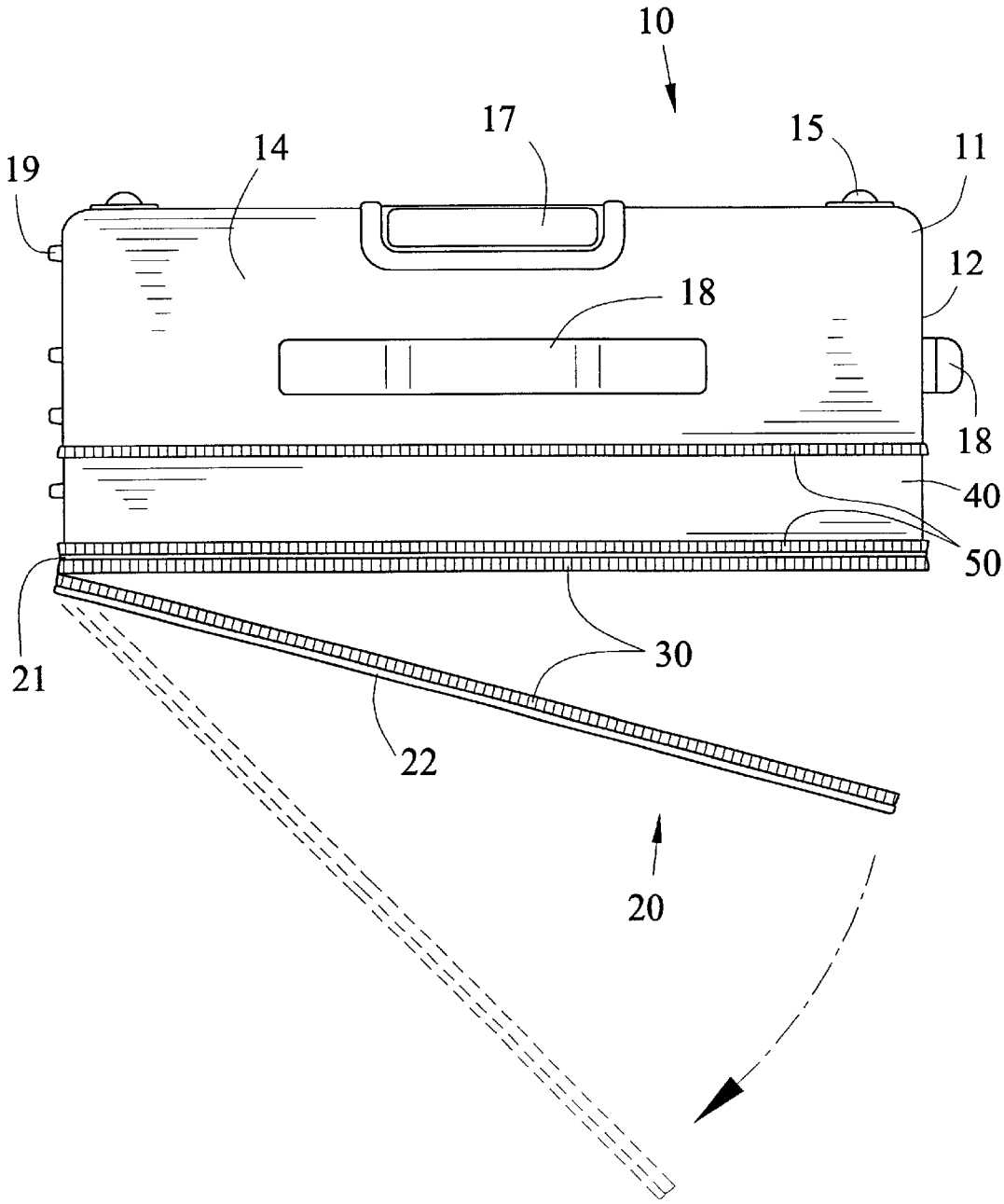
FIG. 5 is an elevational view of the present invention showing that the cover is opened.

Referring to FIG. 5, the cover 20 is an independent unit. When the expandable section 40 is expanded outwards, the user may open the first zipper 30 to cause the cover 22 to turn outwards for opening the inner space of the luggage piece.

It should be noted that for the cover 20 of the present invention, a plurality of auxiliary bags 23 can be installed on the cover 22 for increasing the receiving volume. Even when the expandable section 40 is expanded outwards, the line of the gravitational center of the auxiliary bag 23 remains near the legs 16. Therefore, the influence on stability is less than the prior art.

Figure 6:
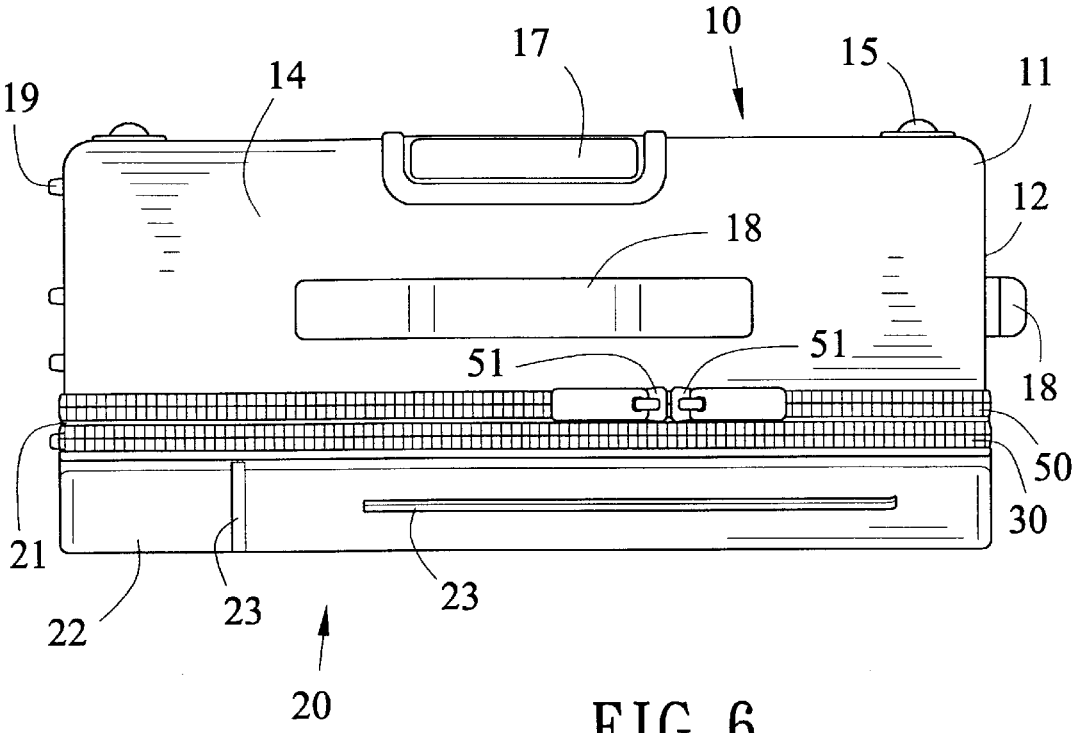
FIG. 6 is an elevational schematic view of the second embodiment of the present invention.

Referring to FIG. 6, in second embodiment, the second zipper 50 of the present invention has two pullers 51. The user may pull the second zipper 50 toward the two sides of the luggage piece so that the expandable section 40 can be expanded rapidly. Similarly, when the puller 51 is operated in the opposite direction, the expandable section 40 can be closed rapidly. Therefore, the operation is convenient and the receiving space in the luggage piece can be adjusted as desired.

Figure 7:
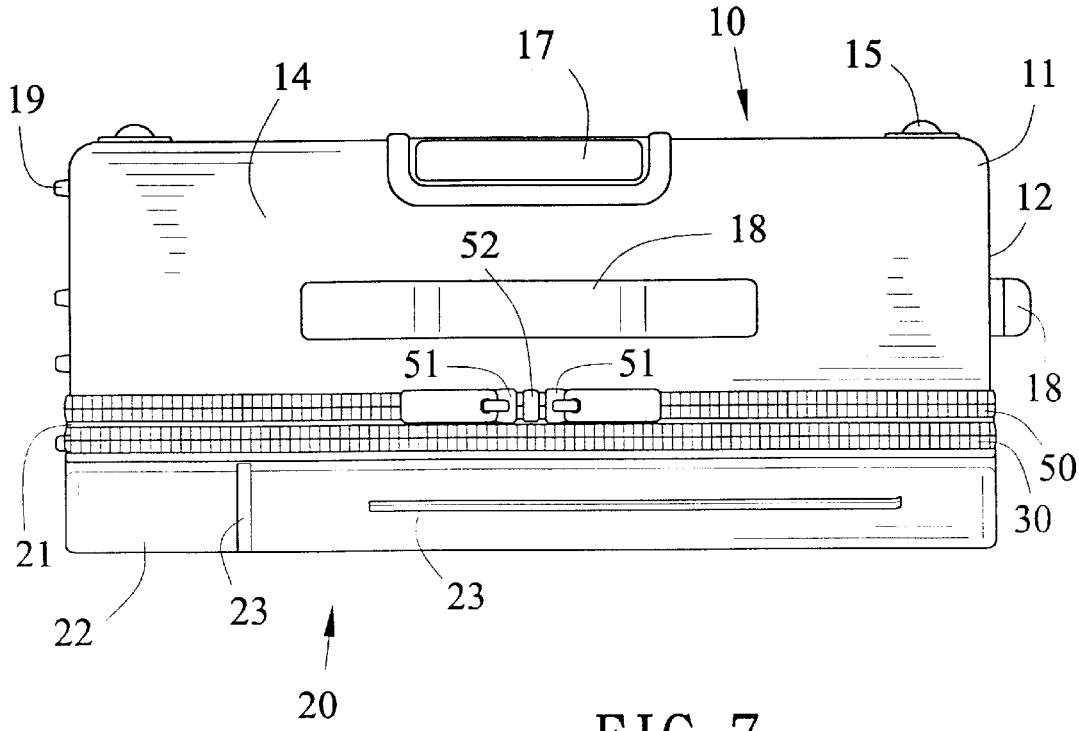
FIG. 7 is an elevational schematic view of the third embodiment of the present invention.

Referring to FIG. 7, in third embodiment, the second zipper 50 of the present invention may be further installed with two pullers 51. The central position can be installed with a stopper 52. As the second zipper 50 is closed, the pullers 51 are exactly positioned on the top 14 of the luggage piece. Thus, it is unnecessary to take time for searching the pullers 51.

Figure 8:
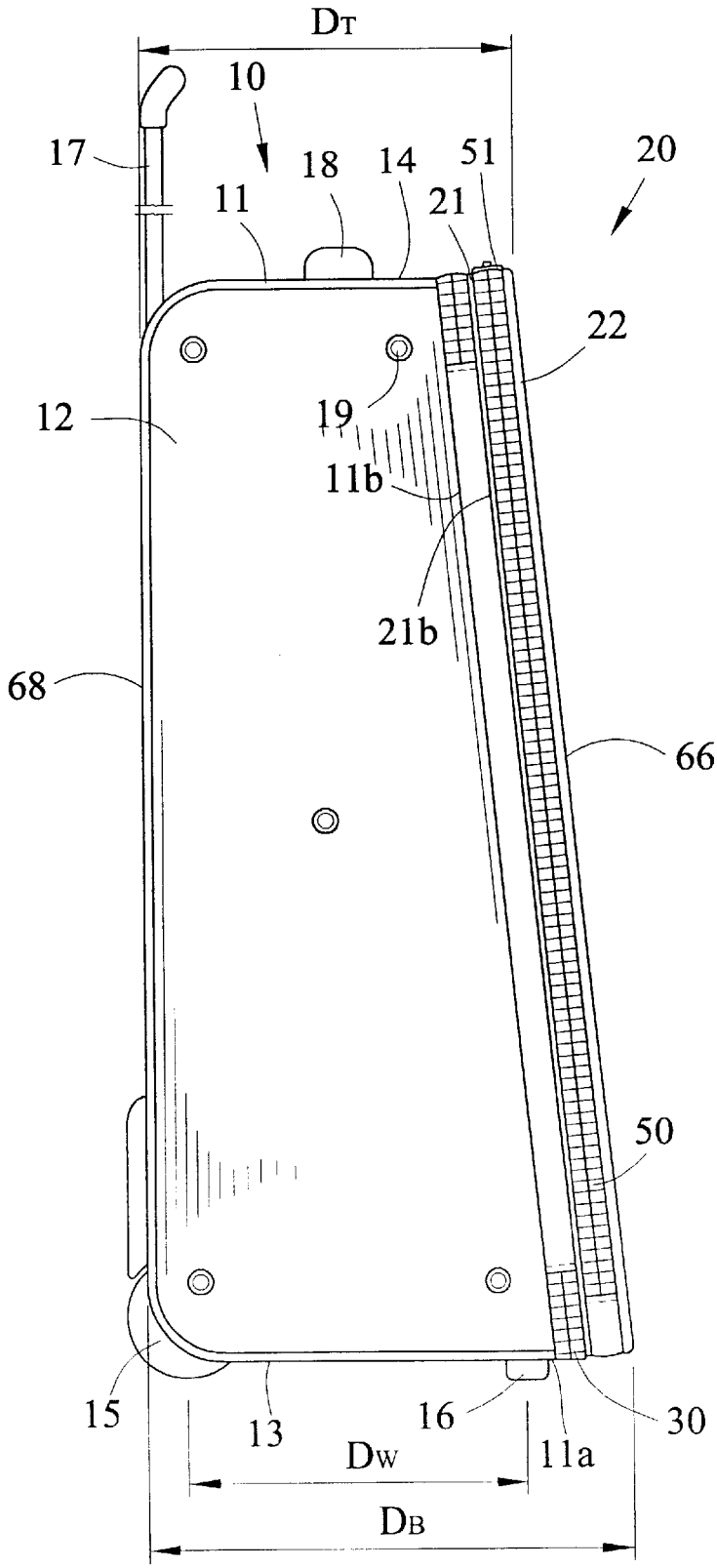
FIG. 8 is a left side view of the fourth embodiment of the present invention.
Figure 9:
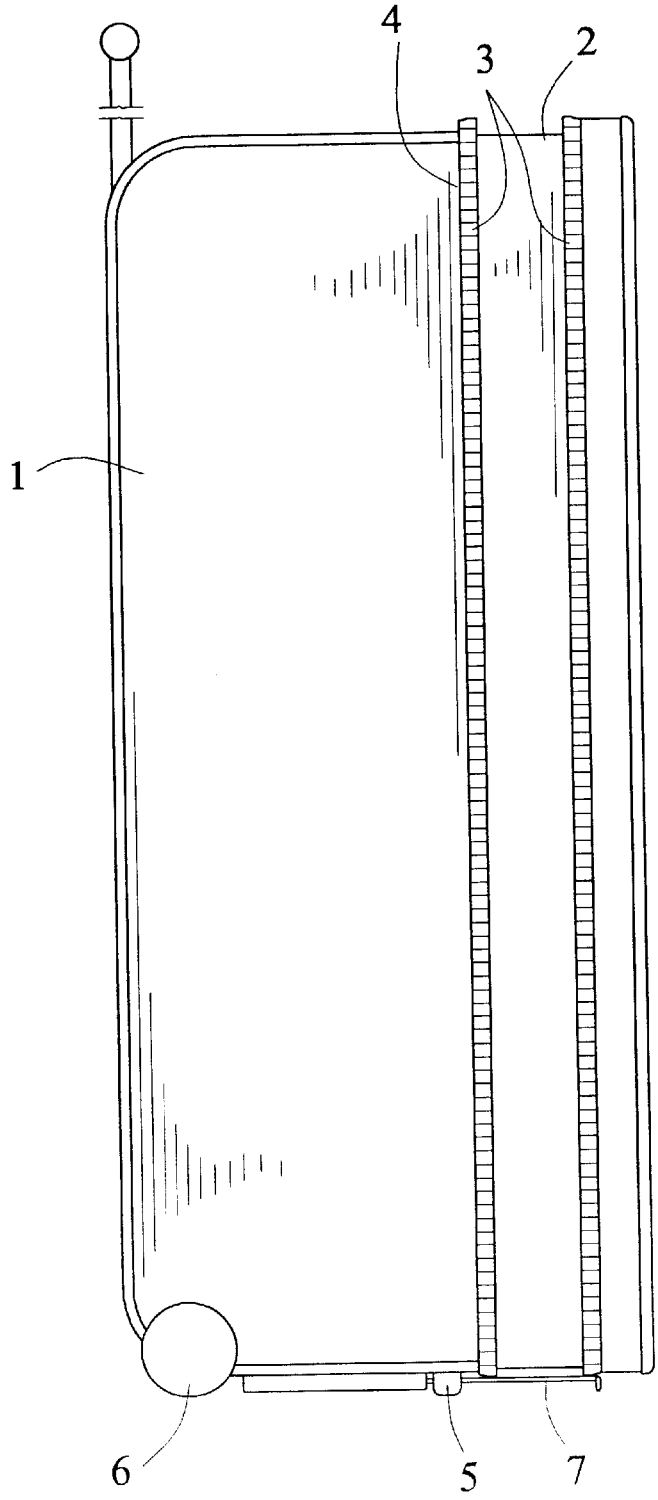
FIG. 9(PRIOR ART)
FIG. 9 is a schematic view of the prior art.

Referring to FIG. 8, in fourth embodiment, the first zipper 30 of the present invention is installed between the body 10 and the cover 20.

The cover 20 is formed by a fiber cloth frame 21 and a cover 22. The cloth edge 21*b* of the fiber cloth frame 21 is seamed with the cloth edge 11*b* of the fiber cloth frame 11.

The length of the first zipper 30 may cover at least the fiber cloth frame 21 and three edges of the fiber cloth frame 11 for opening and closing the receiving space in the luggage piece.

The expandable section 40 is a fiber cloth frame having a non-uniform width. Two lateral seaming edges are fixed to the fiber cloth frame 21 and the cover 22.

The second zipper 50 is installed between the fiber cloth frame 21 and the cover 22 with a configuration like an inverse U shape. The length of the second zipper 50 may cover the three lateral edges of fiber cloth frame 21 and the cover 22 so that fiber cloth frame 21 and the cover 22 can be received tightly. Therefore, the expandable section 40 can be hidden. When the second zipper 50 is opened, the expandable section 40 expands in a sector-like way so as to adjust the receiving space of the luggage piece, as shown in FIG. 3.

The present invention, as thus described, may be varied in many ways. Such variations are not to be regarded as a departure from the spirit and scope of the present invention, and all such modifications as would be obvious to one skilled in the art are intended to be included within the scope of the following claims.

What is claimed is:

1. A luggage piece comprising:

a body (10) having fiber cloth frame (11) and a framework (12), wherein a bottom side (13) has a bottom depth ($D_b$) and a top side has a top depth ($D_t$) smaller than the bottom depth ($D_b$);

a pair of front supports (16) disposed on the bottom side near the front portion;

a pair of rear supports (15) disposed on the bottom side near the rear portion and separated from the front supports (16) by a base depth ($D_W$), wherein the base depth is approximately equal to the bottom depth for providing stability to the luggage piece in the upright position;

a cover unit (20) having a fiber cloth frame (21) and a cover (22); a lower cloth edge **(21*a*) of the fiber cloth frame (21) seamed with a lower cloth edge (11*a*) of the fiber cloth frame (11); a cloth edge (21*b*) of the fiber cloth frame (21) seamed to a cloth edge (22*b*) of the cover (22)**;

a first zipper (30) disposed between the fiber cloth frame (21) and the cover (22) for opening and closing the cover (22); a length of the first zipper (30) equal or longer than that of the three edges of the fiber cloth frame (21) and the cover (22);

an expandable section (40) disposed between the fiber cloth frame (11) and the fiber cloth frame (21) for being connected to the body (10) and the cover (20); and a second zipper (50) disposed between the body (10) and the cover unit (20) with a configuration like an inverse U shape, wherein a length of the second zipper (50) is equal or longer than that of the three lateral edges of the body (10) and the cover unit (20) so that the body (10) and the cover unit (20) are received tightly, and wherein the expandable section (40) is thus hidden therein; and wherein when the second zipper (50) is opened, the expandable section (40) is expanded outwards through a sector-like way so as to adjust the receiving space of the luggage piece; and wherein whereby the zipper (50) can be closed to conceal the expandable section (40) or opened to allow the expandable section (40) to expand outward from the front portion so as to increase the luggage volume by changing the top depth while keeping the bottom depth substantially unchanged.

2. The luggage piece of claim 1 wherein the second zipper (50) has two pullers (51) for rapidly opening closing the expandable section (40).

* * * * *